United States Patent [19]

Taylor

[11] 3,993,395

[45] Nov. 23, 1976

[54] MODULAR SNAP-TOGETHER FUSE BLOCK ASSEMBLY

[75] Inventor: Philip W. Taylor, Howell, Mich.

[73] Assignee: Taylor Industries, Inc., Howell, Mich.

[22] Filed: Jan. 6, 1975

[21] Appl. No.: 538,792

[52] U.S. Cl. ..... 339/198 H

[51] Int. Cl.[2] ..... H01R 9/16

[58] Field of Search..... 339/198 R, 198 G, 198 H, 339/198 K, 198 GA

[56] References Cited

UNITED STATES PATENTS

| | | | |
|---|---|---|---|
| 2,726,375 | 12/1955 | Gordon | 339/198 G |
| 2,780,791 | 2/1957 | Morschel | 339/198 GA |
| 2,892,176 | 6/1959 | Gordon | 339/198 G |
| 3,474,397 | 10/1969 | Piasecki | 339/198 H |
| 3,742,413 | 6/1973 | Taylor | 339/198 G |
| 3,820,060 | 6/1974 | Smith | 339/220 L |

FOREIGN PATENTS OR APPLICATIONS

| | | | |
|---|---|---|---|
| 1,262,398 | 3/1968 | Germany | 339/198 GA |

OTHER PUBLICATIONS

*Electrical World*, Feb. 2, 1959, p. 58.

*Electro–Technology*, Dec. 1962, p. 175.

*Primary Examiner*—Joseph H. McGlynn

*Attorney, Agent, or Firm*—Hauke & Patalidis

[57] ABSTRACT

A modular assembly for mounting a plurality of fuses in electrically insulating enclosures or blocks in side by side relationship on a plane mounting surface. The assembly includes a single sidewall L-shaped fuse support and insulating enclosure and a separate end barrier wall which snap together, forming a double sidewall insulating enclosure of U-shaped cross-sectional configuration. Each L-shaped enclosure includes provisions for interlocking assembly to adjacent L-shaped enclosures. Thus, additional single sidewall enclosures can be assembled to form a block which provides complete electrical insulation for any desired number of fuses.

3 Claims, 6 Drawing Figures

MODULAR SNAP-TOGETHER FUSE BLOCK ASSEMBLY

BACKGROUND OF THE INVENTION

I. Field of the Invention

This invention relates generally to insulating enclosures for mounting electrical devices in a side by side relationship on a plane mounting surface and specifically to a modular snap-together assembly for mounting a plurality of electrical fuses.

II. Description of the Prior Art

The use of an insulating support base and enclosure for mounting fuses or other electrical devices is old and well known in the art. Multiple fuse blocks have been integrally molded to accomodate a specific number of fuses. However, this practice creates problems for users in that they must stock a number of different blocks for each fuse size.

The invention disclosed in U.S. Pat. No. 3,742,413, issued to me on June 26, 1973, for a "Sectional Assembly of Insulating Enclosures for Fuses" overcomes many of the disadvantages associated with prior art multiple fuse blocks. It does so by providing a fuse block assembly of modular construction. Such an assembly allows an insulating block for any desired number of fuses to be built up from only two different modules. This feature greatly reduces the number of parts a user must stock for each fuse size. Although such modular configuration represents a significant advance in the art, it requires individual mounting of each modular unit on the support surface. Thus, for example, a four fuse modular block requires eight mounting screws whereas an integrally molded four fuse block requires only two mounting screws.

SUMMARY OF THE INVENTION

The present invention overcomes many of the disadvantages associated with prior art modular fuse block assemblies. It does so by providing an assembly of substantially identical single sidewall L-shaped fuse support bases and insulating enclosures and a separate end barrier wall which interlockingly snap together forming a fuse block of any desired length. The resultant fuse block is mounted on a plane mounting surface.

A principal object of this invention is to provide an economical and efficient fuse block assembly with no penalty in cost, performance, mounting time, or number of mounting fasteners required compared to the use of conventional integrally molded multiple-fuse blocks for mounting a plurality of fuses on a support base utilizing a modular building block principle requiring only two different elements. The present invention reduces the variety and number of fuse blocks required as compared to conventional fuse blocks. This reduction simplifies many manufacturing, stocking, sales and distribution problems.

It will be understood by those skilled in the art that the present invention is not limited solely to modular snap together assemblies of L-shaped support bases and insulating enclosures and separate end barrier walls for electrical fuses. The invention may be equally well applied to enclosure assemblies for other electrical devices such as electrically operated relays and electronic switches which should be separated and insulated one from the other.

BRIEF DESCRIPTION OF THE DRAWINGS

The many objects and advantages of the present invention will become apparent to those skilled in the art when the following description of the best mode contemplated for practicing the invention is read in conjunction with the accompanying drawings, wherein like reference numerals refer to the same or similar elements, and in which.

DETAILED DESCRIPTION OF THE PREFERRED EMBODIMENT

Figure 1:
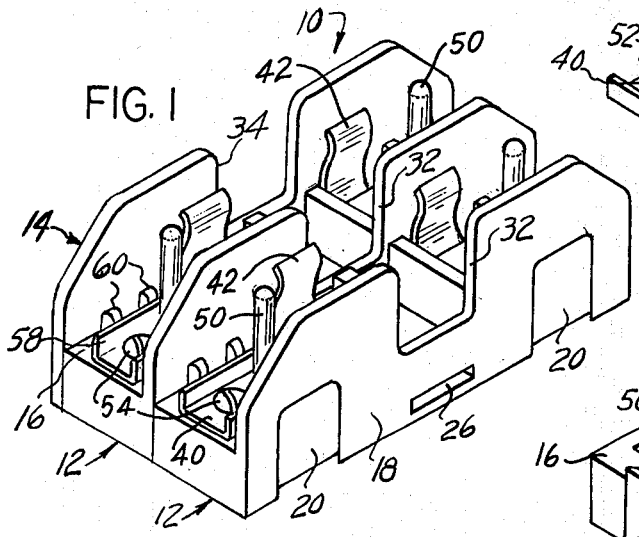
FIG. 1 is a perspective view of the modular snap-together fuse block assembly of the invention.
Figure 2:
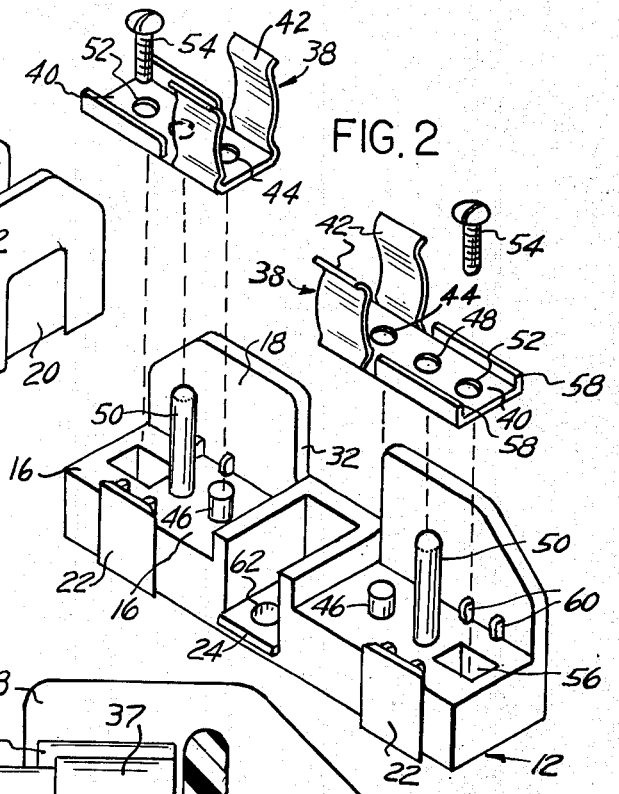
FIG. 2 is a perspective view of a single sidewall L-shaped fuse support base and insulating enclosure.

Referring now to the several figures and more particularly to FIG. 1, there is shown a modular assembly 10 according to the present invention which is made from one or more single sidewall L-shaped fuse support base and insulating enclosures 12 and a separate end barrier wall 14. As best seen in FIG. 2, each insulating enclosure 12 consists of a single piece structure made of molded dielectric material having a fuse mounting base portion 16 and an integral upwardly extending sidewall portion 18. The outer lateral surface of the sidewall portion 18 is provided with a pair of spaced apart female dovetail engagement pockets 20. Mating male dovetail prongs 22 are disposed on the outer lateral surface of the base portion 16 for vertical engagement with the corresponding female dovetail pockets 20. A lateral outwardly extending tongue or ridge 24 is provided on the same surface of the base portion 16 from which the mating male dovetail engagement prongs 22 extend. A mating recess 26 is disposed in the outer surface of the sidewall portion 18 for engagement by the tongue or ridge 24. The tongue or ridge 24 and the mating recess 26 lockingly snap into registry when a pair of substantially identical L-shaped insulating enclosures 12 are assembled by engagement of the dovetail recesses 20 of one enclosure onto mating dovetail prongs 22 of another enclosure and vertical displacement of the first enclosure relative to the second until locked together.

Figure 4:
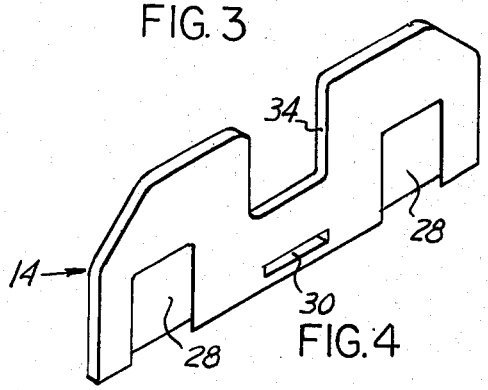
FIG. 4 is a perspective view of an end barrier wall.
Figure 5:
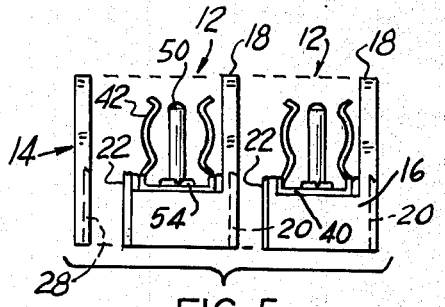
FIG. 5 is an exploded end view of the fuse block assembly shown in FIG. 1.

Referring now to FIG. 4, it is seen that one surface of the separate end barrier wall 14 is provided with female dovetail pockets 28 which are engageable with the male dovetail engagement prongs 22 on the base portion 16 of a single sidewall L-shaped insulating enclosure 12. A lateral recess 30 is provided on the surface of the separate end barrier wall 14 provided with the female dovetail pockets 28. The recess 30 snaps into registry with the tongue or ridge 24 on the base portion 16 when the separate end barrier wall 14 is assembled with a single sidewall L-shaped insulating enclosure 12 in a manner similar to the assembly of two or more insulating enclosures 12.

Figure 6:
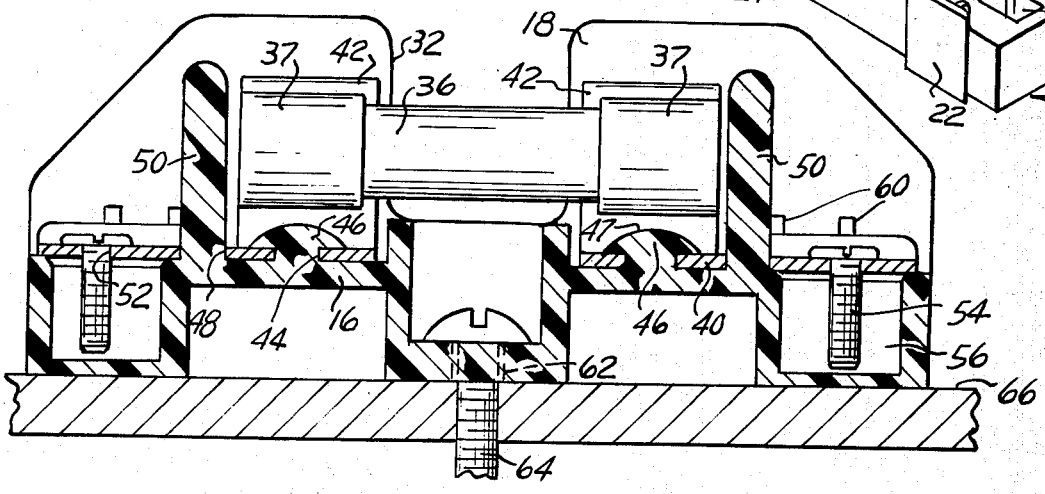
FIG. 6 is an enlarged longitudinal sectional view of the fuse support base and insulating enclosure shown in FIG. 3 as viewed through the line 6—6.

The integral, upwardly extending sidewall portion 18 and the separate end barrier wall 14 are each provided with cutouts 32, 34, respectively, to facilitate the manual insertion and removal of a fuse such as a cartridge fuse 36 as shown in FIG. 6. Each individual L-shaped insulating enclosure 12 is provided with a pair of metallic fuse clips 38. Each fuse clip 38 is generally U-shaped and has a base portion 40 and a pair of integrally formed symmetrically opposed upwardly extending tangs 42 for both holding and electrically contacting the terminal ends 37 of the fuse 36. The base portion 40 of the clip 38 is provided with three apertures 44, 48 and 52. Aperture 44 is adapted to receive a mounting stud 46 integrally projecting from the enclosure base portion 16. Aperture 48 is adapted to receive an integrally molded upwardly extending fuse stop 50. Aperture 52 is internally threaded and adapted to receive a terminal screw 54. When the fuse clip 38 is installed on the base portion 16, the lower portion of the terminal screw 54 extends into an integrally molded, fully insulated rectangular pocket 56 disposed in the base portion 16. The base portion 40 of the clip 38 is additionally provided with a pair of longitudinally disposed, upwardly extending flanges 58 which stiffen the clip and position wire terminal lugs (not shown) when connected with the terminal screw 54.

Figure 3:
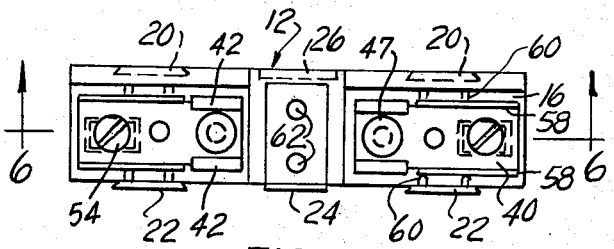
FIG. 3 is a top view of the fuse support base and insulating enclosure shown in FIG. 2.

Stiffening and positioning ribs, as shown at 60 in FIGS. 1, 2 and 3, may be provided for enhancing the rigidity of the integral upwardly extending sidewall portion 18 and the male dovetail engagement prongs 22, and for locating the clips 38 during assembly, with the axes of the clips aligned with the longitudinal axis of the modular L-shaped enclosure 12 as a result of engaging the outer surface of the flanges 58 extending upwardly from the base portion 40 of the clips.

Both the single sidewall L-shaped insulating enclosures 12 and the separate end barrier wall 14 are preferrably molded from thermoplastic rather than thermosetting insulating material. The selection of a thermoplastic material allows the ultrasonic deformation of the integrally molded upwardly extending mounting stud 46 in the form of a rivet head, as shown at 47, to positively secure the clip 38 to the base portion 16 as best shown in the cross-sectional view of FIG. 6.

As can be best seen by reference to FIGS. 3 and 6, the base portion 16 of each insulating enclosure 12 is provided with a pair of centrally located mounting holes 62 through which suitable fasteners 64 may be passed to hold the assembly 10 in engagement with a plane mounting surface 66. Because of the semi-rigid nature of the assembly 10, it is unnecessary to use a fastener 64 in all of the available mounting holes 62. Two or three fasteners will easily suffice to adequately mount a fuse block of modest length.

Some types of cartridge fuses are made in different lengths according to various amperage ratings in order to prevent placing a larger fuse than is required into a predetermined fuse block. End stops, such as the end stops 50 in the fuse block configuration of the present invention, are appropriately spaced apart so as to prevent insertion of a larger than desired fuse. Fuse support and insulating enclosures 12 provided with various distances between the fuse stops 50 may be molded in the same mold by the simple expedient of providing the mold with interchangeable inserts provided with the appropriate mold cavities for forming the fuse stops and the mounting pins 46 at the appropriate locations for accomodating cartridge fuses of various lengths. A single inventory of clips 38 is required, as the elongated pocket 56 in the block base 16 is capable of accomodating the downwardly projecting portion of the terminal attaching screw 54 within a range of positioning of the clips apart from each other.

From the foregoing description it will be apparent to those skilled in the art that a number of changes, adaptations, and modifications of the present invention come within the scope of the present invention, and it is intended that all such variations not departing from the spirit of the invention be considered as within the scope thereof as limited solely by the appended claims.

I claim:

1. A fuse holder sectional assembly for mounting a plurality of individual fuse enclosures in locking side-by-side relationship on a plane mounting surface comprising at least one insulating partial enclosure element including a fuse mounting base portion and a single integral upwardly extending sidewall portion, a separate insulating upwardly extending end barrier wall element, at least one opening in said base portion for accepting a fastener for mounting thereof upon said plane mounting surface, and complementary interlocking means integrally formed on each lateral surface of said partial enclosure element and on a lateral surface of said into wall element, said complementary interlocking means comprising a female dovetail engagement pocket disposed in one of said lateral surfaces, a mating male dovetail engagement prong disposed on the other said lateral surface for slidable vertical engagement into said female dovetail pocket, a tongue projecting from one said lateral surface, and a mating recess in the other said lateral surface for accepting said tongue for causing said tongue and said mating recess to lockingly snap into registry when a pair of said elements are united with the bottom surface of said base portion engaged with said plane mounting surface, a pair of symmetrically disposed fuse clip and terminal integral members, each of said fuse clips and terminal integral members being mounted on said fuse mounting base by means of a mounting lug integral with said mounting base projecting through a first aperture in said fuse clip and terminal member, said mounting lug having an enlarged head portion formed after placing said fuse clip and terminal integral member on said base portion with said mounting lug engaged through said first aperture, a terminal screw threading through a threaded second aperture in said fuse clip and terminal integral member and extending in to an elongated recess in said base portion, and a pair of fuse stop means each in the form of a pin integral with said base portion extending through a third aperture in said fuse clip and terminal integral member for limiting the length of a fuse disposed on said fuse mounting base portion.

2. The sectional assembly of claim 1 wherein said sidewall portion and said end barrier wall element have a cutout portion affording access to a fuse mounting on said base portion.

3. The sectional assembly of claim 1 wherein said complementary interlocking means comprises a pair of said female dovetail engagement pockets in one of said lateral surfaces and a pair of said mating male dovetail engagement prongs on the other of said lateral surfaces.

* * * * *